United States Patent [19]

Ito et al.

[11] 4,292,351

[45] Sep. 29, 1981

[54] METHOD OF BLASTING CONCRETE

[75] Inventors: Yasuro Ito, 4-38-16, Numabukuro, Nakano-Ku, Tokyo; Yoshiro Higuchi, Tokyo; Yutaka Mochida, Hakodate; Hideharu Kaga, Tokyo; Yasuhiro Yamamoto, Kawasaki; Tadayuki Sumita, Tokyo, all of Japan

[73] Assignees: Yasuro Ito; Taisei Corporation, both of Tokyo, Japan

[21] Appl. No.: 31,930

[22] Filed: Apr. 20, 1979

[30] Foreign Application Priority Data

Apr. 28, 1978 [JP] Japan ..... 53-50060
Nov. 17, 1978 [JP] Japan ..... 53-141203

[51] Int. Cl.[3] ..... B05D 1/02

[52] U.S. Cl. ..... 427/403; 118/300; 427/426; 427/427

[58] Field of Search ..... 427/426, 427, 403; 106/97, 102; 118/300

[56] References Cited

U.S. PATENT DOCUMENTS

| | | | |
|---|---|---|---|
| 1,583,918 | 5/1926 | Dunn | 427/196 |
| 1,595,362 | 8/1926 | Schaefer | 427/426 |
| 2,495,540 | 1/1950 | Nichols et al. | 427/426 |
| 3,093,505 | 6/1963 | Conway | 427/427 |
| 3,760,933 | 9/1973 | Maldeis | 427/426 X |
| 3,912,838 | 10/1975 | Kraus | 427/426 X |
| 3,963,849 | 6/1976 | Thompson | 428/426 X |
| 4,046,584 | 9/1977 | Snyder et al. | 106/97 X |
| 4,088,804 | 5/1978 | Cornwell et al. | 427/427 X |
| 4,095,995 | 6/1978 | Ullrich | 106/97 X |
| 4,131,480 | 12/1978 | McCurrich et al. | 106/97 |

FOREIGN PATENT DOCUMENTS

| | | | |
|---|---|---|---|
| 520491 | 1/1956 | Canada | 427/426 |
| 1646890 | 8/1972 | Fed. Rep. of Germany | 427/427 |
| 890010 | 2/1962 | United Kingdom | 427/426 |

*Primary Examiner*—Shrive P. Beck
*Attorney, Agent, or Firm*—Birch, Stewart, Kolasch and Birch

[57] ABSTRACT

A slurry shaped freshly mixed fluid compound such as paste or mortar and coarse or fine aggregate are conveyed under pressure through discrete conduits and then mixed together substantially immediately before blasting. The mixture is blasted through a nozzle against a body to be covered with concrete.

19 Claims, No Drawings

METHOD OF BLASTING CONCRETE

BACKGROUND OF THE INVENTION

Among the various methods of applying concrete there may be mentioned a blasting method. Different from a casting method in which concrete is filled in a mould or frame, according to the blasting method concrete is blasted directly against walls or inclined surfaces so that it is not necessary to fabricate a mould and disassemble the same after setting of the concrete cast therein. Accordingly, the blasting method is widely used in various civil works to coat walls of tunnels or inclined surfaces of created grounds or the like. The prior art concrete blasting methods are generally classified into dry type, wet type and semiwet type. Each of these three types has specific advantages and disadvantages. More particularly, according to the wet type blasting method a fresh fluid mixture of concrete ingredients is conveyed through a conduit in the form of a pipe or hose and then blasted through a nozzle. The physical strength of the resulting concrete is higher than that formed by the dry method. However, the frictional resistance to the fresh fluid concrete mixture while it is being conveyed through the conduit is high so that it is necessary not only to use a high pressure for conveyance but also to use pressure resistant conduit. In addition, it is necessary to limit the size of the aggregate and even with a specially designed conveyer mechanism, the distance of conveyance is limited to atmost 50 to 60 meters which is too short in certain applications. Where the ratio of water to cement is selected to manifest an optimum strength, the viscosity of the freshly mixed fluid concrete becomes large. For this reason, in most field applications, the ratio of water to cement is increased to make easy the conveyance and blasting. This of course decreases the physical strength of the resulting concrete with the result that the layer of the blasted concrete tends to peel off. Moreover, due to the flow of sag of the blasted concrete, the thickness of the layers formed by blasting is limited.

On the other hand, according to the dry method the frictional resistance during conveyance is low so that the dry concrete can be conveyed with a simpler and more compact conveyer mechanism and conduit over any desired distance. Accordingly, it is possible to readily convey the dry concrete over a long distance through tunnels disposed deep in the ground. Thus, this method is suitable for many applications but it generates a large quantity of dust. Therefore, it is necessary to interrupt blasting of the concrete with relatively short periods so as to confirm the result of the blasting. This not only greatly impairs the working environment but also the strength of the resulting concrete layer is only about one half of that obtained by the wet method because it is difficult to cause cement and aggregate to intimately contact with water. Moreover, the loss of concrete material due to splash is large. According to the semiwet method which may be said an intermediate method of the wet and dry methods the water pouring position is displaced from the nozzle to an intermediate portion of the conduit. When water is added the frictional resistance of the mixture increases and since a quick setting agent is often added, the distance of displacement is limited to 5 to 6 meters from the nozzle. When this distance is increased beyond this limit, a paste like concrete mixture would adhere to the inner surface of the conduit thus clogging the same. Accordingly, the resistance to the flow increases at the end of the conduit thus greatly decreasing the advantage of the dry method. Moreover, it is difficult to thoroughly admix water and cement as in the wet method. Thus, in each case, for the purpose of improving adhesion of the applied freshly mixed fluid concrete and of decreasing splash and peel off it is necessary to incorporate a large amount of such quick or instant setting agent as sodium silicate, calcium chloride, sodium aluminate, sodium carbonate, etc.

SUMMARY OF THE INVENTION

Accordingly, it is an object of this invention to provide an improved method of blasting concrete capable of adequately conveying concrete ingrediates, smoothly blasting a concrete mixture having a small ratio of water to cement, decreasing splash and dust thereby efficiently forming blasted concrete.

Another object of this invention is to provide a method of blasting concrete capable of decreasing the quantity of cement utilized for blasting and making uniform and stable the mixture to be blasted.

According to this invention, there is provided a method of blasting concrete comprising the steps of preparing a slurry like freshly mixed fluid composition by admixing a powder of hydraulic substance and water, conveying under pressure the slurry like freshly mixed fluid composition and an aggregate through discrete conduits to a remote position, admixing the slurry like freshly mixed fluid composition and the aggregate at the remote position to form a mixture, and blasting the mixture against a body to be coated with concrete.

According to a modification of this invention the method comprises the steps of preparing a dry mixture of a powder of hydraulic substance, a fine aggregate and a coarse aggregate, dividing the dry mixture into two parts, adding water and concrete to one part to prepare slurry like freshly mixed fluid concrete, conveying under pressure the slurry like freshly mixed fluid concrete and the other part of the dry mixture through discrete conduits to a remote position, admixing the slurry like freshly mixed fluid concrete and the other part of the dry mixture at the remote position to form a mixture and blasting the mixture against a body to be coated with concrete.

PREFERRED EMBODIMENT OF THE INVENTION

We have found many new facts regarding the rheology characteristic of a fresh fluid mixture, that is a mixture not yet set after incorporation of water, the actual flow characteristic of the fresh fluid mixture, the interface adhesion function between an inert aggregate such as a coarse aggregate and a paste or mortar, and the adsorption at solid surfaces and have proposed a number of new processes based on these discoveries, as fully disclosed in Japanese patent application No. 157452/1976 laid open to public inspection on July 20, 1978 under number 82389/1978 (method of measuring the fluidity of a plastic fluid, method of preparing such plastic fluid, and method and apparatus for pouring the plastic fluid), Japanese patent application No. 147180/1976 laid open to public inspection on June 26, 1978 under under number 71859/1978 (method and appparatus for metering aggregate, and method and apparatus for determining the amount of water to be admixed) and Japanese patent application No.

126323/1977 laid open to public inspection on May 15, 1979 under number 60321/1979 (method and apparatus for preaparing concrete).

More particularly, when creating a plastic flow of a plastic fluid (Bingham type or non Bingham type) such as cement containing paste, mortar and concrete (solid components) there is a yielding point in the shear strength which varies depending upon the quantity of admixed water, water to cement ratio, cement to sand ratio, coarse aggregate to sand ratio, the quantity of a dispersing agent, and the initial content of water in sand. According to a slump test which has been used to measure the fluidity of concrete determines qualitatively the fluidity. Such qualitatively measured value can not clarify the actual state of the plastic fluid and such state should be determined by quantatively measured values. In such a plastic fluid the function of water between solid particles is not completely lost. More particularly, attractive force exists between the surfaces of solid particles (including cement particles) so that as the amount of the water adhered to the surfaces of the solid particles decreases greatly, the attractive force between adjacent particles would increase substantially since the water adheres jointly to adjacent particles. When the ingredients are mixed after adding water, it has been considered that hydration and coagulation proceed immediately after incorporation of the water. However, during a substantial interval following incorporation of water and admixing, the relative fluidity increases. Accordingly, when the mixture is kneaded again after an elapse of such interval the adhesion of cement to the coarse aggregate, that is the strengh of the resulting concrete and its fluidity can be improved.

The shear strength increases in proportion to the amount of water removed from the fresh fluid mixture (plastic fluid). Such dehydration can be made by using a filler paper or by adding dry or semidry mixture to the fresh fluid mixture. When the fresh fluid mixture is dehydrated, a large bonding force would appear between adjacent solid particles. More particularly, in the dry method, since there is no interval after kneading, it can be understood that the strength of the resulting concrete is small whereas where the mixture is kneaded again as above described the strength of the blasted concrete increases correspondingly.

According to the method of this invention, water is added to such hydraulic particles as cement and plaster and then the mixture is thoroughly kneaded to sufficiently increase the specific surface area of the powder. Thereafter the resulting concrete paste or mortar having an adequate water to cement ratio is conveyed through a conduit. After incorporation of water and kneadinng, it is advantageous to let the resulting mixture standstill for a substantial time. The pressure for conveying the mixture is determined by the following equation $$\Delta P = \sqrt{\frac{L_{max}}{L_{max} - L}}\,(F_o + \lambda Uf)L + \rho h \qquad 1$$

where $L_{max}$ is a maximum distance of conveyance and expressed by $$L_{max} = \frac{UfT}{\epsilon} = \frac{X}{Uf\epsilon}$$

-continued where $L = \frac{Uft}{\epsilon}$

The speed Uf necessary to pour at a constant speed and under a pressure P (g/cm$^2$) over a distance L (cm) is given by the following equation $$Uf = \frac{\Delta P\sqrt{4 \times LF_o\lambda\epsilon + P^2\epsilon^2 + 4X^2\lambda^2} - (2XLF_0\lambda + \Delta P^2\epsilon)}{ZXL\lambda^2} \qquad 2$$

where $\Delta P = P - \rho h$

The maximum speed $Uf_{max}$ that can move the mixture at a constant speed over a distance L(cm) is given by the following equation $$Uf_{max} = \frac{X}{L - \epsilon} \qquad 3$$

The final pressure of the mixture when it has been conveyed over a distance of L(cm) at a constant speed Uf(cm/sec.), that is the pressure Pn at an orifice is given by the following equation $$Pn = \frac{(F_o + \lambda Uf)L}{\sqrt{1 - \frac{Uf}{Uf_{max}}}} + \rho h \qquad 4$$

In equations 1 through 4,

| | |
|---|---|
| $F_o$ (g/cm$^2$) : | relative shear strength |
| $\lambda$ (g . sec/cm$^3$ . cm) : | relative flow viscosity coefficient |
| Uf (cm/sec) : | vacant speed |
| $\rho$ (g/cm$^3$) : | weight per unit volume of the plastic fluid |
| L (cm) : | length of the aggregate layer |
| $\epsilon$ : | percent voide of the aggregate |
| X (cm$^2$/sec) : | quantity of cast cement per unit time |
| T (sec) : | maximum pourable time |

These equations are described in the specification of Japanese patent application No. 157452/1976.

According to this invention the green composition can be conveyed by a pump by utilizing the fluidity of the hydraulic powder caused by the added water or when such ingredients (gravel, sand and cement) are dry. The distance and the quantity of the ingredient that can be conveyed are determined depending upon the pressure of the pump and the diameter of the conduit. When the mixture is dry, it is possible to convey it over a distance of several hundreds meters, or more than 1000 meters.

The materials are conveyed separately and mixed together before blasting. When the mixture is conveyed immediately after incorporation of water to the hydraulic powder, substantial interval is taken during the conveyance, and dry materials are incorporated after the conveyance, the materials with suitable fluidity can be then dehydrated to increase the shear stress yielding value, thus improving the physical characteristics of the fresh fluid mixture, workability, control, economy and the field of use, with the result that the fluidity and adhesion which contradict each other can be solved.

More particularly, a fresh fluid mixture was prepared by using a quantity of Portland cement and 3% by weight of the cement of a dispersing agent of the alkyl sulfonate type. The mixture was kneaded again after a standstill of one hour and its characteristics were measured by passing it through a pipe having a length of 20 cm and containing glass beads having a diameter of 8 mm which act as resistance bodies and obtained results as shown in the following table 1. A mixture having a water to cement ratio of less than 28% was impossible to measure its fluidity whereas where the ratio is higher than 31% breezing occurred and at a ratio higher than 32%, water has segregated from cement particles.

TABLE 1

| water to cement ratio of a cement paste | relative shear stress yielding value $F_o$ | relative fluidity viscosity coefficient $\lambda$ | relative closure coefficient $\Delta F_o$ |
|---|---|---|---|
| 28% | 6.923 g/cm$^3$ | 18.8 g . sec/cm$^4$ | 0.075 g/cm$^4$ |
| 30% | 0.273 g/cm$^3$ | 10.3 g . sec/cm$^4$ | 0.002 g/cm$^4$ |

This result shows that when water is added to cement, the state of changing from a capillary state in which all interstices between the particles are not filled with water to a slurry state in which the interstices are filled with water can be clearly noted. In other words, in the capillary state the frictional resistance between solid particles acts as the shear stress so that the mixture can not flow, whereas in the slurry state the mixture is flowable. To obtain a cement paste free from breezing or segregation, the water to cement ratio becomes a minimum of about 28 to 30%. The relative shear stress yielding value in this range is calculated as follows:

$$6.293/0.273=23.051$$

Thus, the maximum value is 23 times of the minimum value. The relative fluidity viscosity coefficient increases by a factor of 1.825 and the relative closure coefficient by a factor of 47.5. As above described, even a slight variation in the water to cement ratio causes a large variation in the fluidity. When such flowable slurry is blasted against a vertical steel plate, the blasted slurry immediately flows down thus forming a thin layer having a thickness of less than several millimeters, meaning a failure of satisfactory blasting.

According to the prior art blasting method, it is necessary to prepare a slurry having lesser fluidity to eliminate this difficulty or to add quick setting agent or to increase the thickness of the resulting concrete layer by blasting the slurry intermittently. Each of these solutions requires a longer time and increases the steps.

According to this invention, a slurry having a high degree of fluidity is conveyed through a conduit, and immediately before blasting the slurry, a dry powder of the aggregate conveyed through the other conduit is incorporated into the slurry thus blasting the slurry in a capillary state. By this method, the quantity of water between the solid particles is decreased thus increasing the attractive force. More particularly, where a cement paste having a high fluidity (water to cement ratio of about 30%) is conveyed through a conduit and then mixed with an aggregate conveyed through the other conduit immediately before a nozzle, then the water to cement ratio of the blasted concrete is greatly reduced. For example, with about 15% of cement at the time of blasting, the water to cement ratio is decreased to 26% or less, thus creating the capillary state with high adhesive power. Thus, it is possible to greatly improve the shear strength and adhesive force without relying upon a hydration reaction. For this reason, it becomes possible to substitute a portion of the cement powder with an inert powder having the same specific surface area such as a powder of silica.

Where dry sand having smaller specific surface area is conveyed through one conduit and then mixed with a paste conveyed through the other conduit, the maximum ratio of sand to paste corresponds to the amount of the paste that covers the surface of the sand particles in the form of extremely thin layers and completely fills the interstices between the sand particles. Although different depending upon the particle size of the sand, the quantity of the paste becomes a value slightly in excess of 30%. Since the sand absorbs water in the paste, the water to cement ratio of the paste decreases. The relationship among the quantities of the water, cement and sand establishes a perfect capillary state thus leaving extremely thin water layers between the sand particles and between the cement particles thereby greatly increasing the shear strength and the adhesive power.

In the above described mortar wherein sand is added to a cement paste, the initial water content of the sand varies as disclosed in Japanese patent application No. 147180/1976 even with the same water to cement ratio, cement to sand ratio and cement to dispersing agent ratio. For example, in a composition wherein the water to cement ratio is 40%, the cement to sand ratio is 1:1 and the dispersion agent to cement ratio is 0.9%, when sands having different water contents varying from absolute dry to 40% are admixed in a mixer evacuated to a pressure of −65 cm Hg until a mixture having a predetermined water content is obtained. After adding cement to the mixture it was left standstill for one hour. Then an alkyl allyl sulfonate type dispersion agent was added to the mixture and it was kneaded again. The physical characteristics of the resulting mixture are shown in the following Table 2. The fluidity was measured with a glass tube filled with 20 mm glass beads and used to obtain the result shown in Table 1.

TABLE 2

| water content of sand (%) | temp. (°C.) | $\rho$ (Kg/l) | $F_o$ (g/cm$^3$) | $\Delta F_o$ (g/cm$^4$) | $\lambda$ g . sec/cm$^4$ | breezing rate (%) | segregation rate (%) | bending strength Kg/cm$^3$ 7 days | bending strength Kg/cm$^3$ 28 days | compression strength Kg/cm$^3$ 7 days | compression strength Kg/cm$^3$ 28 days |
|---|---|---|---|---|---|---|---|---|---|---|---|
| 0 | 13 | 2.177 | 0 | 0 | 5 | 0 | 82 | 74.5 | 74.6 | 441 | 529 |
| 5 | 20 | 2.196 | 0.04 | 0.0007 | 4 | 8.1 | 76 | 86.8 | 85.3 | 460 | 603 |
| 10 | 20 | 2.157 | 0.319 | 0.0041 | 3 | 0 | 92 | 92.1 | 100.5 | 413 | 745 |
| 14 | 20 | 2.137 | 1.623 | 0.0092 | 3 | 0 | 90 | 89.6 | 96.5 | 497 | 746 |
| 18 | 19.5 | 2.157 | 2.169 | 0.021 | 4 | 0 | 99 | 95.3 | 102.1 | 610 | 780 |
| 22 | 19.5 | 2.157 | 1.394 | 0.01 | 3 | 0 | 104 | 95.4 | 92.1 | 594 | 698 |
| 26 | 20 | 2.157 | 2.544 | 0.031 | 2 | 0 | 102 | 104 | 91.9 | 611 | 755 |
| 30 | 19.5 | 2.157 | 1.244 | 0.014 | 3 | 0 | 100 | 93.3 | 80.1 | 533 | 749 |
| 35 | 20 | 2.157 | 0.469 | 0.0018 | 3 | 0 | 101 | 93.2 | 92.2 | 525 | 739 |

TABLE 2-continued

| water content of sand (%) | temp. (°C.) | $\rho$ (Kg/l) | $F_o$ (g/cm$^3$) | $\Delta F_o$ (g/cm$^4$) | $\lambda$ g . sec/cm$^4$ | breezing rate (%) | segregation rate (%) | bending strength Kg/cm$^3$ 7 days | bending strength Kg/cm$^3$ 28 days | compression strength Kg/cm$^3$ 7 days | compression strength Kg/cm$^3$ 28 days |
|---|---|---|---|---|---|---|---|---|---|---|---|
| 40 | 13 | 2.177 | 0.841 | 0.0046 | 4 | 0 | 101 | 100.9 | 91.3 | 530 | 751 |

As can be noted from this Table, the physical characteristics such as the fluidity, breezing rate and the segregation rate of the resulting mortar vary greatly depending upon the water content of the sand used. Especially, the relative shear stress yielding value $F_o$ varies greatly. It is believed that this is caused by the arch action of the fluid with respect to the passage. Hence, it is considered that this value is determined by the size of the particles. The thickness of the blasted cement is larger when a cement powder is incorporated into sand containing a large quantity of water than in a case where a cement powder is incorporated into sand containing lesser quantity of water, for example less than 10% thus increasing $F_o$. When the water content exceeds a predetermined value, for example 30%, the cement immediately becomes a slurry thus forming water layers between the sand particles and the paste layers, thus decreasing the coating effect of the paste over the sand particle. In this case, the value of $F_o$ decreases. It should be particularly noted that in the experiment described above, after standstill the mixture was kneaded again. Even with such severe kneading, the layers of cement paste that have coated the sand particles did not peel off, thus increasing the value of $F_o$ as above described. This means that the paste has a considerably large adhesive force, in other words, the cement powder adheres to the surfaces of the sand particles with a small quantity of surface water, thus increasing the bonding force with decreased water to cement ratio.

Owing to the phenomena described above, the spacing between sand particles coated with the paste is decreased as a result of the blasting to a distance at which strong attractive force creates while sand, coarse aggregated and a powder which are conveyed through another conduits are blasted against breezed flowable paste to convert also the flowable paste into the capillary state, whereby the fluidity of the paste is decreased to assure stable cement layer.

In carrying out the method of this invention, it is advantageous to add a control box for adjusting the quantity of sand and coarse aggregate which are added at the blasting nozzle to meet the requirement at the wall surface to be coated. For example, at the time of starting the blasting supply of the coarse aggregate is stopped so as to form a prime layer with only a paste or mortar and then add the coarse aggregate and sand to form an overlayer. On the other hand, where the wall is sufficiently wetted by underground water or the like, a small quantity of a mixture of cement and the aggregate is firstly blasted to form a prime layer and then mortar or paste is added to the mixture to form an overlayer. Thus, various operations can be taken in accordance with the case to minimize splash or peel off.

In order to efficiently increase the coating effect over the sand particle as described above, it is advantageous to admix cement with sand containing a suitable amount of water and then add water to prepare a mortar. If water is firstly added to sand and cement is then added, the result would be the same as if cement is admixed with said containing more than 40% of water, so that it would be impossible to increase said coating effect. As has been pointed out hereinbefore it is advantageous to prepare a fresh fluid mixture or mortar or paste, then left standstill the mixture for an interval in which the relative fluidity increases, knead again the mixture, and finally convey and blast it under pressure. The second kneading can be made while the mixture is being conveyed through the conduit without the necessity of using a mixer. Generally, the aggregate may be incorporated at the nozzle or immediately before the nozzle. Alternatively, the aggregate may be added to the wall surface while blasting thereto cement or mortar. The mortar or paste may be conveyed by pressurized air or pump, whereas the aggregate is conveyed by pressurized air. If desired, metal fiber, glass wool or other fibrous material may be added to the aggregate.

Furthermore, it is possible to add to the slurry fresh fluid mixture one or more of such additives as fly ash, granulated slag powder, bozzolan, water glass, colloidal silica, high molecular weight plastics, calcium chloride, alum, sodium aluminate, sodium carbonate, and sodium hydroxide.

Use of a quick setting agent stabilizes the blasting step, and such agent is added independently to the fresh fluid mixture and the aggregate. The fresh fluid mixture, aggregate and pressurized air may be suitably heated. Refractory materials can be used as the aggregate and a sol or colloidal alumina cement or a silica sol can also be used to prepare the fresh fluid mixture.

When admixing the fresh fluid mixture with a powdery additive conveyed by pressurized air the fresh fluid mixture must be uniformly dispersed. To this end, it is advantageous to discharge the mixture through a pipe with decreasing diameter or through a plate having a discharge opening of a reduced diameter. With these expedients, as it is possible to discharge the fresh fluid mixture at a higher speed and under a higher pressure to create a dispersed condition suitable for mixing. The reduction in the diameter of the discharge port should be at least 10%. Although extreme reduction is not advantageous because it increases the internal pressure of the conduit it is generally possible to reduce the discharge port to have a diameter less than one half of the diameter of the conduit. In the examples to be described later the diameter of the discharge port was reduced to 1.5, 1.25, $\frac{3}{4}$, 0.5 and $\sqrt[3]{}$ inches respectively when the conduit for conveying the green mixture had an internal diameter of 2 inches, but in each case satisfactory dispersion was obtained.

Where the green mixture is conveyed under pulsating pressure, the effect of the pulsating pressure can be alleviated by providing a closed buffer chamber near the discharge port thus preventing shock and vibration of the conduit. This permits use of a reciprocating piston for conveying the green mixture.

To have a better understanding of the invention the following examples are illustrated but not for limitation.

EXAMPLE 1

One part of Portland cement was mixed with 0.35 part of water and 0.01 part of an additive to prepare a paste (green mixture) having an initial shear strength $F_o=0.2$ (g/cm$^3$), $\Delta F_o=0.001$ g/cm$^4$, and $\lambda=0.4$ g.sec/cm$^4$. This paste was conveyed by a screw pump at a rate of 30 l/min. This mixture was added to dry river sand having a grain size less than 2.5 mm and conveyed by a blower at a rate of 30 l/minute at a position of a conduit for conveying the sand, about 3 m ahead of the nozzle. The conduit for conveying the paste had an inside diameter of 5.08 cm (two inches) while, the conduit for conveying the sand had the same inside diameter. The inner diameter of paste conduit was reduced to 2.54 cm (one inch) over a length of 10 cm at which the sand conduit was connected Then, the paste was dispersed to be mixed well with the added sand and the resulting mixture was blown to a vertical wall surface.

So long as the thickness of the blasted concrete layer is less than 7 cm, the wall scarecely sags. Three days after formation, the layer had a compression strength of 251.3 Kg/cm$^2$, while after 7 days 395.2 Kg/cm$^2$ and after 28 days 515.6 Kg/cm$^2$. Analysis of the blasted layer showed one part of cement and 1.5 parts of sand.

EXAMPLE 2

The same paste as in Example 1 was conveyed under the same condition. A 50—50 (by weight) mixture of dry sand having a grain size of less than 2.5 mm and crushed stone having a grain size of 10 to 15 mm was conveyed at a rate of 30 l/min and then mixed with the paste at a position 3 m from the tip of a nozzle. The resulting mixture was blasted against a vertical wall surface.

The maximum shear strength of the concrete layer thus formed was 118 g/cm$^2$ and no sag was observed even on a wall surface having a thickness of only 15 cm. The compression strength was 347 Kg/cm$^2$ after 3 days, 484.3 Kg/cm$^2$ after 7 days and 653 Kg/cm$^2$ after 28 days, showing that a satisfactory concrete layer was formed.

EXAMPLE 3

In the same manner as in Examples 1 and 2, 1 part of cement was admixed with 6.35 part of water to prepare a paste. The paste was left standstill for one hour at a temperature of 40° C. Then 0.01 part of an additive was added and kneaded again for 3 minutes in a mixer.

This paste was conveyed in the same manner as in Example 2 and admixed with a mixture of dry river sand having a particle size of less than 2.5 mm and crushed stone having a grain size of 10 to 15 mm and conveyed at a rate of 30 l/min. The resulting mixture was blasted against a vertical wall surface.

Again no sag was noted when the mixture was blasted against a wall having a thickness of 15 cm. The compression strength of the concrete layer was 468 Kg/cm$^2$ after 3 days, 628.6 Kg/cm$^2$ after 7 days and 672 Kg/cm$^2$ after 28 days showing an excellent concrete layer.

EXAMPLE 4

One part of Portland cement, one part of sand 0.37 part of water and 0.008 part of an additive were mixed together to prepare a mortar having an initial shear stress yielding value $F_o=0.19$ g/cm$^3$, $\Delta F_o=0.0003$ g/cm$^4$, and $\lambda=1.6$ g.sec/cm$^4$. The fluidity of the mortar was excellent. This mortar was conveyed through a pipe having an inner diameter of two inches at a rate of 30 l/m by means of a pump. Dry river sand having a grain size of 5 mm was conveyed by a blower at a rate of 20 l/min and admixed with the mortar at a point 3 meters ahead of the nozzle tip. The resulting mixture was blasted against a vertical wall surface. In this case, the distance between the sources of the mortar and the river sand and the wall surface was about 150 m and the inner diameter of the conduits was 2 inches and the pressure was 7 Kg/cm$^2$. In the same manner as in Examples 1 and 2, the inner diameter of the sand conduit was reduced to 1.25 inches at the point of admixing with sand. Again, no sag was noted on a vertical wall having a thickness of 15 cm. The initial maximum shear strength of the blasted concrete layer was 93 g/cm$^2$ and its compression strength was 288 Kg/cm$^2$ after 3 days, 430 Kg/cm$^2$ after 7 days and 543 Kg/cm$^2$ after 28 days.

EXAMPLE 5

One part of cement, one part of sand, 0.36 part of water and 0.01 part of an additive were mixed together to prepare a mortar having a $Fo=0.43$ g/cm$^3$, $\Delta Fo=0.01$ g/cm$^4$ and $\lambda=1.3$ g.sec/cm$^4$. The mortar was conveyed under pressure at a rate of 30 l/min.

A 50:50 (by weight) mixture of dry river sand having a grain size of 5 mm, and crushed stone having a grain size of 5 to 15 mm was conveyed by pressurized air and then admixed with the mortar at a ratio of 1:0.42 and the resulting mixture was blasted against a vertical wall surface.

At the start of the blasting, only the mortar was blasted to form a prime layer on the surface of the wall. Then, the quantity of the added aggregate was gradually increased until the aforementioned ratio is reached for the purpose of increasing the bonding force to the vertical surface and to reduce the amount of splash. The result of analysis of the blasted concrete showed 1 part of cement, 1.5 parts of sand, 0.5 part of the coarse aggregate, and 0.36 part of water. The compression strength of the concrete layer was 215 Kg/cm$^2$ after 3 days, 428 Kg/cm$^2$ after 7 days, and 526 Kg/cm$^2$ after 28 days.

EXAMPLE 6

The same mortar as in Example 5 was conveyed under pressure and admixed with a mixture comprising 30% of dry river sand having a grain size of 5 mm, and 70% of gravel having a grain size of 5 to 15 mm and the resulting mixture was blasted against a vertical wall in the same manner as in Example 5.

The result of analysis of the blasted concrete layer was one part of cement, 1.36 of sand, 0.84 part of gravel and 0.36 part of water. The concrete layer had a maximum shear strength of 138 g/cm$^2$. it was found that the concrete is possible to blast against an arcuate ceiling. The compression strength of the blasted layer was 228 Kg/cm$^2$ after 3 days, 436 Kg/cm$^2$ after 7 days and 548 Kg/cm$^2$ after 28 days.

EXAMPLE 7

A mortar similar to those of Examples 5 and 6 was prepared except using the additive and left standstill for one hour at a temperature of 40° C. After adding 0.01 part of an additive, the mixture was kneaded again in a mixer in the same manner as in Example 4. The resulting mortar was admixed with the same aggregate as in Example 6 and blasted in the same manner. The result of analysis showed that the resulting concrete layer had a composition consisting of one part of cement, 1.36 parts of sand, 0.84 part of gravel and 0.36 part of water. However, different from Example 6, the compression strength of the concrete layer was 418 Kg/cm$^2$ after 3 days, and 523 Kg/cm$^2$ after 7 days which are considerably higher than those of Example 6. The compression strength after 28 days was 573 Kg/cm$^2$.

EXAMPLE 8

One part of cement was added to 3.8 parts of river sand whose water content has been adjusted to 8.5%. After blending the cement and sand, gravel having a grain size of 5 to 15 mm was added in an amount corresponding to 82% of the mixture and the resulting mixture was conveyed by compressed air. A mortar prepared in the same manner as in Examples 4 and 5 was incorporated into the aggregate to prepare a mortar. The mortar was then blasted. The ratio of the aggregate to the mortar was 1:4. The resulting concrete layer had a composition consisting of 1 part of cement, 1.63 parts of sand, 0.89 part of gravel and 0.34 part of water and the maximum shear strength was 235 g/cm$^2$ in the as blasted state, 352 Kg/cm$^2$ after 3 days, 538 Kg/cm$^2$ after 7 days and 625 Kg/cm$^2$ after 28 days.

EXAMPLE 9

One part of cement, one part of sand, 0.36 part of water and 0.01 part of an additive were admixed to prepare a mortar. Thereafter, one part of gravel having a grain size of 5 to 15 mm was added to prepare a slurry like green mixture having a slump value of 23 cm, showing that the mixture still retained the characteristic of a slurry after incorporation of the gravel.

As a control, one part of cement was mixed with 3.8 parts of river sand whose surface water content has been adjusted to 7% to cause the surface of the river sand to be apparently dry. To this mixture was added 8 parts of gravel having a grain size of 5 to 15 mm and the resulting aggregate was conveyed by compressed air and then admixed with the slurry mixture. The resulting aggregate-slurry mixture was blasted. The ratio of slurry to aggregate was about 1:4 and the resulting concrete layer had a composition consisting of one part of cement, 1.56 part of sand, 2.4 parts of gravel and 0.34 part of water. The maximum shear strength of the as blasted concrete was 350 g/cm$^2$, 347 Kg/cm$^2$ after 3 days, 489 Kg/cm$^2$ after 7 days and 595 Kg/cm$^2$ after 28 days.

EXAMPLE 10

One part of cement, one part of sand, 0.36 part of water and 0.01 part of an additive were mixed together to prepare a mortar having Fo=0.43 g/cm$^3$, ΔFo=0.01 g/cm$^4$ and λ=1.3 g.sec/cm$^4$. 2% by volume of glass fiber was added to the mortar. The resulting slurry composition had a spreading flow value of 245 mm when measured by the Japanese Industrial Standard (JIS) R 5201.

River sand containing 8% of water and 0.26 parts of cement were incorporated into the slurry to cover the sand particles with cement and the resulting aggregate mixture was conveyed by compressed air and then mixed with the slurry composition containing glass fiber.

The ratio of the aggregate to the slurry was 1:5 and the blasted concrete layer had a composition consisting of one part of cement, 1.14 parts of sand, 0.054 part of fiber, and 0.357 part of water, the volume ratio of the fiber being 1.76%. The blasted layer had a maximum shear strength of 175 Kg/cm$^2$ and showed no sag although no quick setting agent was used.

The resulting concrete layer had a compression strength of 258 Kg/cm$^2$ and a bending strength of 68 Kg/cm$^2$ after 3 days; a compression strength of 383 Kg/cm$^2$ and a bending strength of 97 Kg/cm$^2$ after 7 days; and a compression strength of 537 Kg/cm$^2$ and a bending strength of 125 Kg/cm$^2$ after 28 days showing that the concrete had extremely high compression strength and bending strength.

EXAMPLE 11

One part of cement, one part of sand, 0.38 part of water and 0.01 part of an additive agent were mixed together to prepare a mortar having Fo=0.2 g/cm$^3$, ΔFo=0.001 g/cm$^4$ and λ=0.8 g.sec/cm$^4$. This mortar had a high fluidity.

An aggregate was prepared by adding one part of cement to 3.3 parts of sand having a grain size of 2.5 mm and whose surface water has been adjusted to 10%. The mixture was blended in a dry state to coat the sand particles with cement. Then 0.66 part of steel fiber was mixed with the aggregate. The resulting aggregate was conveyed by compressed air having a pressure of 10 Kg/cm$^2$. The above described mortar was added to the aggregate at a ratio of 1:1 and then blasted.

The resulting concrete layer had a maximum shear strength of 355 g/cm$^2$ and a composition consisting of one part of cement, 2.2 parts of sand, 0.36 part of steel fiber, 0.30 part of water, and 0.004 part of the additive. The concrete layer had a compression strength of 385 Kg/cm$^2$ after 7 days, and 498 Kg/cm$^2$ after 28 days and a bending strength of 75 Kg/cm$^2$ after 7 days and 113 Kg/cm$^2$ after 28 days.

EXAMPLE 12

A mortar-aggregate mixture similar to that shown in Example 9 was prepared except that 0.05 part based on one part of sand of synthetic fiber (0.18 part based on one part of cement) was used instead of the steel fiber.

The blasted cement layer had a compression strength of 348 Kg/cm$^2$ after 7 days and 476 Kg/cm$^2$ after 28 days, and a bending strength of 66 Kg/cm$^2$ after 7 days and 108 Kg/cm$^2$ after 28 days.

EXAMPLE 13

A mortar similar to those of Examples 11 and 12 was prepared except that no additive was used. After left standstill for 70 minutes at a temperature of 38° to 41° C., 0.01 part of an additive was added to the mixture and the mixture was kneaded again.

An aggregate was prepared in the same manner and to have the same composition as in Example 9. The aggregate was mixed with the mortar and blasted.

The resulting cement layer had the same composition as that of Example 9 but had a compression strength of 437 Kg/cm$^2$ after 7 days which is considerably higher than that of Example 9 and a bending strength of 101 Kg/cm$^2$. After 28 days the compression strength was 507 Kg/cm$^2$ and the bending strength was 118 Kg/cm$^2$.

EXAMPLE 14

The same mortar as in Example 9 was prepared, and an aggregate to be added thereto was prepared from one part of cement, 3 parts of sand having a grain size less than 2.5 mm, 3 parts of gravel having a particle size of 5–15 mm, and 0.8 part of steel fiber having a diameter of 0.2 mm and a length of 15 mm. After adjusting the surface water of the sand to 1%, the cement was admixed therewith. Thereafter the gravel and the steel fiber were incorporated. The conditions as in Example 9 were used except that the ratio of the aggregate to the mortar was selected to be 1.2:1.

The blasted concrete layer had a composition consisting of one part of cement, 2.1 parts of sand, 1.2 parts of gravel, 0.34 part of water and 0.44 part of steel fiber, and a maximum shear strength of about 800 g/cm$^2$. The percentage of splash at the time of blasting was 4.8%. The concrete layer had a compression strength of 205 Kg/cm$^2$ after 3 days, 413 Kg/cm$^2$ after 3 days, and 505 Kg/cm$^2$ after 28 days. The bending strength was 69 Kg/cm$^2$ after 7 days and 125 Kg/cm$^2$ after 28 days.

EXAMPLE 15

Alumina cement was added to a refractory powder obtained by pulverizing anolcite clay and silicate refractory substance at 1:1 ratio. 0.4 part of water was added to the mixture to prepare a flowable green composition having $Fo=0.7$ g/cm$^3$, $\lambda=6.2$ g.sec/cm$^4$ and $\Delta Fo=0.004$ g/cm$^4$.

Graphite and magnesia were added to dolomite to form a lump. After calcination, the lump was crushed to obtain a granular refractory aggregate having a grain size of 10 to 20 mm. The green composition described above was added to this refractory aggregate.

After left standstill for 3 hours, the green mixture was kneaded again and then conveyed at a rate of 30 l/min by a pump by using its fluidity imparted by water. The green mixture was dispersed and admixed with the coarse aggregate conveyed at a rate of 30 l/min by compressed air at a point 3 meters ahead of the blasting nozzle and the resulting mixture was blasted against an iron cylinder to form a refractive layer having a thickness of 18 cm. During the blasting step no sag was noted, thus forming a protective layer having a uniform thickness. The resulting layer had a composition consisting of one part of alumina cement, 1.7 parts of the granular refractory material, 0.9 part of refractory granular coarse aggregate, and 0.4 part of water. 24 hours after blasting the layer had a compression strength of 262 Kg/cm$^2$.

EXAMPLE 16

The same green composition and the refractory coarse aggregate as those of Example 15 were used. However, a refractive powder having a grain size of less than 1 mm and whose surface water has been adjusted to 8% by weight by adding water was added to the coarse aggregate. The other conditions were the same as those of Example 13. The compression strength after 24 hours was 284 Kg/cm$^2$.

When a suitable quantity of a coarse aggregate such as gravel is added to the slurry like green mixture and then admixing the mixture with dry coarse or fine aggregate more advantageous result can be obtained. In this case, since the coarse aggregate is incorporated into both fresh fluid mixture and dry powder it may be considered that the coarse aggregate renders difficult the blending operation, it makes the preparation of materials easy to admix beforehand such solid components as sand, gravel and cement and to add water into a portion thereof to form a freshly mixed fluid compound. Addition of the coarse aggregate to the fresh fluid mixture increases its volume thus decreasing the quantity of cement. When compared with the method disclosed in the prior application, in which sand is added to both fresh fluid mixture and the dry composition, the method of this invention can increase the amount of incorporation of the coarse aggregate thus producing a blasted cement layer having a layer mechanical strength. Moreover, since both materials being conveyed contain aggregates and have substantially the same mass it is possible to readily combine them to obtain homogeneous product. The following Example 17 shows this case.

EXAMPLE 17

One part of cement, one part of sand, 0.38 part of water, 0.007 part of an additive were mixed together to prepare a mortar and a portion of gravel having a particle size of 5 to 15 mm was added to the mortar to obtain a slurry like freshly mixed fluid composition having a slump value of 24 cm showing that the freshly mixed fluid composition has a performance of a slurry irrespective of the fact that it contains gravel. As a control, one part of cement was added to 3.8 parts of sand acting as an aggregate and having a particle size of 2.5 mm, the surface water of the sand having been adjusted to 8% to cover the sand particles with cement layers. Such sand particles have apparently dry surfaces. Then 3.9 parts of gravel having a grain size of 5 to 15 mm was added to the sand and the resulting mixture was conveyed to a nozzle by compressed air. The slurry like green composition was added to the mixture near the nozzle and then blasted against a surface.

In this case, the slurry like green compound and the aggregate were admixed at a ratio of 1:1.2 and the resulting concrete layer had a composition consisting of one part of cement, 1.81 part of sand, 1.93 parts of gravel, 0.33 part of water and 0.003 part of the additive. The maximum shear strength of the concrete layer was 273 g/cm$^2$ and its compression strength was 343 Kg/cm$^2$ after 3 days, 536 Kg/cm$^2$ after 7 days and 642 Kg/cm$^2$ after 28 days. On the other hand, a mortar containing the same amounts of cement, sand and water as has been described just above, but not containing gravel and containing 0.005 part of the additive had $Fo=3.5$ g/cm$^3$, $\Delta Fo=0.04$ g/cm$^4$ and $\lambda=4$ g·sec/cm$^4$. To this mortar was added an aggregate having the same composition at a ratio of 1:1.2 and the resulting mixture was blasted against a surface. The blasted concrete has a composition consisting of one part of cement, 1.63 parts of sand, one part of gravel, 0.35 part of water and 0.004 part of the additive showing that the amount of the gravel was reduced to one half and sand has also been decreased correspondingly. In other words the amount of the cement was substantially small. The blasted concrete had a maximum shear strength of 205 g/cm$^2$, and its compression strength was 332 Kg/cm$^2$ after 3 days, 515 Kg/cm$^2$ after 7 days and 615 Kg/cm$^2$ after 28 days.

EXAMPLE 18

One part of cement, one part of sand, 0.38 part of water and 0.006 part of an additive were mixed together to prepare a mortar having $Fo=3$ g/cm$^2$, $\Delta Fo=0.04$ g/cm$^4$ and $\lambda=33$ g·sec/cm$^4$. 25% by volume of glass fiber was mixed with this mortar to prepare a slurry like composition having a flow value of 220 mm when measured in accordance with JIS R 5201.

As a control 0.26 part of cement was added to one part of river sand containing 8% of water to coat the surfaces of the sand grains with the cement and the mixture was conveyed by compressed air. Then the slurry like green composition containing the glass fiber was incorporated into the mixture at a ratio of 4:1 and then blasted.

The blasted concrete had a composition consisting of one part of cement, 1.5 part of sand, 0.076 part of the glass fiber, and 0.36 part of water, the volume ratio of the fiber being 2%. The blasted concrete layer had a maximum shear strength of 213 $Kg/cm^2$. No sag was noted even though no rapid setting agent was used.

After blasting, the concrete layer had a compression strength of 273 $Kg/cm^2$, and a bending strength of 82 $Kg/cm^2$ after 3 days. After 7 days, the compression strength was 411 $Kg/cm^2$ and the bending strength was 103 $Kg/cm^2$, whereas after 28 days, the compression strength was 571 $Kg/cm^2$ and the bending strength was 136 $Kg/cm^2$.

EXAMPLE 19

1 Kg of cement, 2 Kg of sand containing 10% of surface water and 2 Kg of gravel were thoroughly mixed together. The mixture was divided into two parts at a ratio of 1:1.25. To the first part were added 0.2 part of cement, 0.1 part of water and 0.003 part of an additive to prepare a slurry like composition having a slump value of 23 cm. This slurry like composition was conveyed by a pump while the other part was conveyed by compressed air and they are combined near a blasting nozzle and then blasted.

The resulting concrete layer had a composition consisting of one part of cement, 1.4 part of sand, 1.4 parts of gravel, 0.31 part of water and 0.006 part of the additive, and had a maximum shear strength of 213 $g/cm^2$. The compression strength of the concrete layer was 285 $Kg/cm^2$ after 3 days, 421 $Kg/cm^2$ after 7 days and 623 $Kg/cm^2$ after 28 days.

In this example, after admixing, the mixture of cement, sand and gravel was divided into two parts. Then water and cement were added to one of the parts to form the slurry like composition. Accordingly it is possible to simplify the mixing facilities. Especially, the weighing and charging system which weigh and charge respective ingredients prior to mixing can be simplified because only one such system is sufficient for sand and gravel.

As above described, according to this invention a paste or mortar, a coarse aggregate such as gravel and a fine aggregate such as sand are conveyed by discrete conduits, so that it is possible to convey the mortar or paste in a slurry state which manifest flowable property. Further, the coarse and fine aggregates are conveyed in a dry state thus making it possible to readily convey them through a conduit. Consequently, it is easy to convey these ingredients over a long distance with a relatively simple conveyer facility. At the blasting field these separately conveyed ingredients are combined and then blasted in a capillary state in which high shear strength can be provided and splash and peel-off can be minimized. Moreover, as powdery substances such as cement are conveyed as a paste or mortar by adding water to the powdery substances, the problem of generation of dust can be solved, thus improving the operation environment. Moreover, as the water to cement ratio is decreased, the solid substances directly attract each other with no or extremely thin water layers therebetween it is possible to produce concrete layers having high strength and large thickness. Thus, the invention makes it possible to advantageously blast cement mixture which has been impossible with wet, dry or semiwet type method. Furthermore, according to this invention, it is possible to decrease the amount of cement, to simplify the preparation of the substances to be blasted and can uniformly admix the dry ingredient and slurry like composition.

What is claimed is:

1. A method of blasting concrete or mortar against a surface to be coated utilizing a blasting nozzle which comprises the steps of preparing a slurry-like freshly mixed fluid composition by admixing a powder of hydraulic substance and water, conveying said slurry-like freshly mixed fluid composition to a remote location through a conduit, under pressure, conveying an aggregate through a separate conduit to said remote location under pressure, combining said slurry-like composition and said aggregate at said remote location by introducing said slurry-like composition into the conduit conveying said aggregate to form a unified mixture and conveying said mixture through a common conduit to said blasting nozzle, and blasting said unified mixture against the surface to be coated, said unified mixture being formed substantially immediately before said blasting nozzle.

2. The method according to claim 1 wherein said slurry like freshly mixed fluid composition comprises a paste prepared by incorporating water into a hydraulic substance or a mortar prepared by adding fine solid aggregate to said paste.

3. The method according to claim 1 wherein said aggregate comprises gravel, sand or mixture thereof.

4. The method according to claim 1 wherein the quantity of the water is selected such that it renders to said mixture a capillary state.

5. The method according to claim 1 wherein said slurry-like freshly mixed fluid composition is prepared by mixing a powder of hydraulic substance with a granular substance containing a predetermined quantity of water.

6. The method according to claim 2 wherein said mortar is prepared by firstly admixing sand and cement and then adding water to the resulting mixture.

7. The method according to claim 1 which further comprises the steps of permitting said slurry-like mixture to stand still for a predetermined interval, and then kneading said slurry-like mixture again before conveyance.

8. The method according to claim 1 wherein said hydraulic substance comprises alumina cement and said aggregate comprises refractory coarse aggregate, refractory fine aggregate or both.

9. The method according to claim 1 wherein said slurry-like composition is incorporated with at least one member selected from the group consisting of fly ash, granulated slag, pozzolan, water glass, colloidal silica, high molecular weight plastics, calcium chloride, sodium aluminate, sodium carbonate and sodium hydroxide.

10. The method according to claim 1 wherein said aggregate is incorporated with at least one member selected from the group consisting of metal fiber, synthetic fiber, asbestos, rock wool, and blast furnace wool.

11. The method according to claim 1 wherein the percentage of said aggregate in said blasted mixture is gradually increased.

12. The method according to claim 1 wherein the diameter of the conduit used for conveying said slurry-like composition is reduced at the point where said slurry-like composition is incorporated with said aggregate, so as to disperse said slurry-like composition therein.

13. The method according to claim 3 wherein said aggregate is conveyed in a dry state by compressed gas.

14. The method of claim 1 wherein the slurry-like freshly mixed fluid composition is conveyed by a pump means and the aggregate is conveyed by a pressurized air stream.

15. The method of claim 14 wherein the slurry-like freshly mixed fluid composition is introduced into the aggregate pressurized air stream immediately before said blasting nozzle.

16. A method of blasting concrete against a surface to be coated utilizing a blasting nozzle which comprises the steps of preparing a dry mixture of a powder of hydraulic substance, a fine aggregate and a coarse aggregate, deviding said dry mixture into two parts, adding water and cement to one part to prepare a slurry-like freshly mixed fluid composition concrete, conveying under pressure said slurry-like freshly mixed fluid concrete and the other part of said dry mixture through separate discrete conduits to a remote location, combining said slurry-like freshly mixed fluid concrete and said other part of said dry mixture at said remote location by introducing said slurry-like composition into the conduit conveying said aggregate to form a unified mixture and conveying said mixture through a common conduit to said blasting nozzle, and blasting the unified mixture against the surface to be coated, said unified mixture being formed substantially immediately before said blasting nozzle.

17. The method of claim 16 wherein the slurry-like freshly mixed fluid composition is conveyed by a pump means and the aggregate is conveyed by a pressurized air stream.

18. The method of claim 17 wherein the slurry-like freshly mixed fluid composition is introduced into the aggregate pressurized air stream immediately before said blasting nozzle.

19. The method of claim 1 or 16 wherein the surface is coated with a unified mixture having an improved relative shear stress yielding value relative to the fluid composition.

* * * * *